US006010266A

United States Patent [19]

Schrepf

[11] Patent Number: 6,010,266

[45] Date of Patent: Jan. 4, 2000

[54] APPLICATOR SYSTEM FOR FLUID COSMETIC MATERIAL

[75] Inventor: Volker Schrepf, East Islip, N.Y.

[73] Assignee: Henlopen Manufacturing Co., Inc., Melville, N.Y.

[21] Appl. No.: 08/410,931

[22] Filed: Mar. 27, 1995

Related U.S. Application Data

[63] Continuation of application No. 08/055,675, Apr. 30, 1993, abandoned.

[51] Int. Cl.[7] ..... A45D 34/00

[52] U.S. Cl. ..... 401/126; 401/119; 401/129; 401/130; 401/284

[58] Field of Search ..... 401/119, 129, 401/130, 205, 284, 126; 132/218

[56] References Cited

U.S. PATENT DOCUMENTS

| | | | |
|---|---|---|---|
| 66,446 | 7/1867 | Beach | 401/119 |
| 566,558 | 8/1896 | Bell | 401/284 |
| 1,542,333 | 6/1925 | Buehrer | 401/205 X |
| 1,603,842 | 10/1926 | Colpe . | |
| 1,705,256 | 3/1929 | Krusi . | |
| 1,915,599 | 6/1933 | Ellison | 401/119 |
| 1,935,639 | 11/1933 | Keeshan . | |
| 2,791,789 | 5/1957 | Smith et al. | 401/119 |
| 2,869,162 | 1/1959 | Dritz | 401/119 X |
| 2,996,749 | 8/1961 | Hester . | |
| 3,010,139 | 11/1961 | Parker . | |
| 3,203,025 | 8/1965 | Schreur . | |
| 3,246,657 | 4/1966 | Roller, Sr. . | |
| 3,369,543 | 2/1968 | Ronco . | |
| 4,286,005 | 8/1981 | Berger . | |
| 4,452,262 | 6/1984 | Jankewitz . | |
| 4,764,046 | 8/1988 | Kitamura et al. | 401/284 X |
| 4,776,718 | 10/1988 | Heinzmann et al. . | |
| 4,822,193 | 4/1989 | Berger . | |
| 4,841,996 | 6/1989 | Gueret | 401/129 X |
| 4,854,759 | 8/1989 | Morane et al. | 401/119 |
| 4,913,175 | 4/1990 | Yokosuka et al. | 401/284 X |
| 5,097,853 | 3/1992 | Nehashi . | |

FOREIGN PATENT DOCUMENTS

| | | | |
|---|---|---|---|
| 940464 | 5/1948 | France | 401/119 |
| 1258080 | 2/1961 | France | 401/129 |

*Primary Examiner*—Steven A. Bratlie

[57] ABSTRACT

A cosmetic applicator system including a container for storing a fluid cosmetic material such as eyeliner, and an applicator having a hollow stem formed with a reservoir, a felt applicator tip with a body portion inserted in the distal end of the stem, and a plurality of longitudinal channels extending along the passage in surrounding relation to the body portion of the tip for conducting liquid cosmetic material from the container to the reservoir when the tip is immersed in the container, and from the reservoir to the tip when the applicator is used to apply the cosmetic material after withdrawal from the container.

15 Claims, 1 Drawing Sheet

APPLICATOR SYSTEM FOR FLUID COSMETIC MATERIAL

This is a Continuation of application Ser. No. 055,675, filed Apr. 30, 1993 now abandoned.

BACKGROUND OF THE INVENTION

This invention relates to systems for applying a fluid cosmetic material, and more particularly to an applicator system including an applicator having a product reservoir in communication with a semi-rigid tip for extended and precise application of a fluid cosmetic product such as eyeliner.

As used herein, the term "fluid cosmetic material" means a cosmetic material comprising a liquid vehicle, typically having particulate solid components such as pigments dispersed therein, and capable of flowing as a fluid. Present-day eyeliner compositions are examples of such materials, especially suitable for use with the present invention.

Eyeliner applicator systems which currently are available have many drawbacks. The eyeliner product of one current system is stored in a container or reservoir, and the applicator tip is made from flexible fibers. In use, the applicator is inserted into the reservoir and absorbs an amount of product for use. The user brushes the product onto the eye to create a draw line, similar to a paint brush.

Because the fiber applicator tip of this system is flexible, the user's skill and sensitivity to application pressure are determinative factors in controlling the width of the draw line. If the user cannot aptly control the application pressure, the fiber tip may flare, resulting in a variable width of the draw line. This creates an irregular appearance and usually requires the user to remove the makeup and repeat the application.

Another drawback to the flexible fiber applicator system is that the applicator can carry only a small amount of product, often less than is necessary to create a complete draw line with a single stroke. Thus, the user frequently must interrupt each eyeliner application to reload more product, by reinserting the applicator into the reservoir. Additionally, flexible fiber applicators are difficult and costly to assemble.

Some years ago, pen type applicators were introduced in the market to alleviate the problems encountered with the flexible fiber applicators. The pen type applicator is fed from an internal reservoir, similar to a fountain pen. The applicator tip is made from a porous material, typically foam. The tip is shaped for controlled application and is structurally supported internally by a fibrous wick. The wick also transfers product from the internal reservoir to the tip by capillary action.

Although the pen type applicator system solves many problems inherent in the flexible fiber applicators, the pen type system nevertheless has many significant drawbacks. First, because the eyeliner product is fed through a fibrous wick by capillary action, the pen type system cannot handle viscous product.

The pen type applicator system is further limited in use by the particle size of the components of the eyeliner product. The pen type system was developed in Japan for use with carbon black pigmentation, whereas cosmetics sold in the United States employ iron oxides instead of carbon black. However, the particle sizes of iron oxides are much too large to flow through the wick material and foam of the pen type applicators. When iron oxides are used with the pen type applicator, the iron oxide particles essentially get caught within the wick and the foam applicator, and filter out of the product as the product travels through the applicator, with the result that the coverage and coloration of the eyeliner are drastically reduced until the product dries up altogether, rendering the product unusable.

Additionally, the pen type applicator does not solve the problem of irregular draw line width. If the user does not control the application pressure, product may splatter from the foam tip like a sponge, creating an inconsistent draw line. Finally, the cost of the pen type applicator is excessively high for the marginal improvement over the flexible fiber applicators.

Other attempts have been made to correct the problems of eyeliner application, including the use of elastomeric thermoplastic tips, uncoated or coated with flocking material. However, none of these approaches totally resolves the recurring problem of draw line inconsistency, and none has provided an acceptable degree of extended application.

SUMMARY OF THE INVENTION

It is an object of the present invention to provide an eyeliner applicator that creates a consistent draw line by virtue of the applicator design, and not from the user's skill of application.

Another object is to provide an eyeliner applicator that can carry enough product to allow a user to apply a draw line with a single stroke of the applicator.

A further object is to provide an eyeliner applicator that can accommodate eyeliner products having wide ranges of viscosities and pigment particle sizes.

To these and other ends, the present invention broadly contemplates the provision of a system for applying a fluid cosmetic material, including means for defining a first reservoir for holding a body of the cosmetic material, and having an opening for access to the first reservoir; and an applicator for transporting quantities of the cosmetic material from the first reservoir to a user's face, the applicator having a stem with a distal end insertable through the opening into contact with the cosmetic material in the first reservoir, and a tip having a nib portion exposed at the distal end of the stem for applying the cosmetic material to the face; wherein the applicator has a second reservoir spaced from its distal end for receiving a quantity of the cosmetic material, the stem has a passage communicating between its distal end and the second reservoir, and the tip has a body portion inserted in the passage and cooperating therewith to define a path for flow of the cosmetic material between the distal end of the stem and the second reservoir, through the passage and externally of the body portion, such that cosmetic material flows from the first reservoir to the second reservoir when the distal end of the stem is in contact with the cosmetic material in the first reservoir, and flows from the second reservoir to the nib portion during subsequent application of cosmetic material from the nib portion to a user's face or like application locality.

As a further and particular feature of the invention, the flow path comprises a plurality of channels spaced around and extending along the body portion of the tip in the passage of the stem. Thus, the stem can be formed with a plurality of internal longitudinal splines, spaced around the passage and engaging the body portion of the tip, for defining therewith the channels; these channels open through the distal end of the stem such that cosmetic material from the second reservoir flows therethrough over the nib portion. Additionally, a vent is provided in the applicator for equalizing pressure between the second reservoir and ambient atmosphere, to ensure continuous free flow of the cosmetic material during application. Preferably or conveniently, the second reservoir with its vent are formed in the applicator stem, i.e., at the proximal end of the passage containing the tip body portion.

The tip is a formed synthetic felt body having sufficient rigidity so that the nib portion is self-sustaining in shape under manual cosmetic-applying pressures.

In a further aspect, the invention contemplates the provision of an applicator, for use with a container holding a body of a fluid cosmetic material, having the features and characteristics described above.

In the described system and applicator, for example as used for application of eyeliner, the second reservoir collects and stores enough product to allow a user to apply a draw line with a single stroke of the applicator, and refills automatically when the stem and tip are reinserted into the container. Because the applicator tip is in fluid communication with the second reservoir through channels extending along the outer surface of the tip, the eyeliner product freely flows from the second reservoir to the tip in a controlled manner, even though it contains relatively large pigment particles. The applicator tip, made of synthetic profiled, semi-rigid felt, is gentle enough to avoid irritation or abrasion, but can accept various application pressures without becoming distorted.

Further features and advantages of the invention will be apparent from the detailed description hereinafter set forth, together with the accompanying drawing.

DETAILED DESCRIPTION

Figure 1:
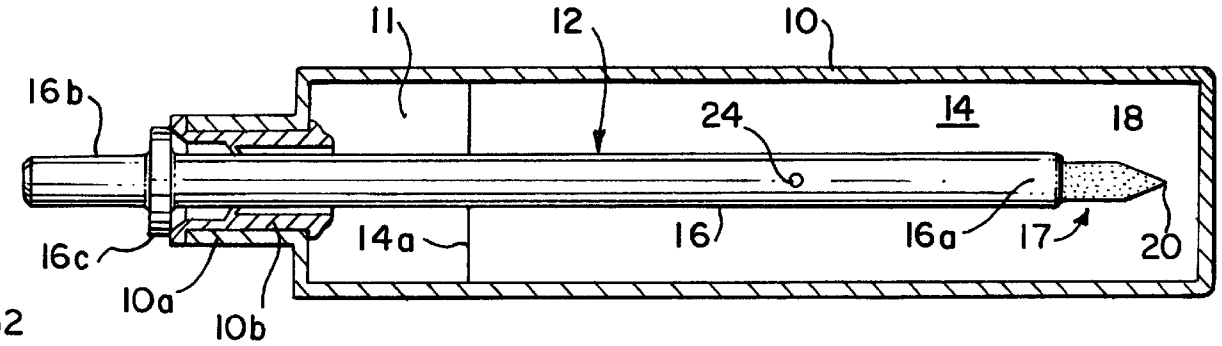
FIG. 1 is an enlarged longitudinal sectional view of an eyeliner applicator system embodying the present invention in a particular form.

The invention will be described, with reference to the drawing, as embodied in an eyeliner applicator system including an outer container 10 (FIG. 1) defining a first or primary reservoir 11, and an applicator 12. The primary reservoir 11 holds a body of fluid cosmetic material 14, viz. a generally conventional eyeliner product. The applicator is removably stored within outer container 10, and includes a stem 16 and a tip 17. The tip 17 has an application nib portion 18 with an application end 20 at its distal extremity.

More particularly, the container 10 is an elongated vessel of cylindrical or other cross-section, dimensioned to fit within a user's handbag or pocket, being generally similar in size, shape and fluid capacity to conventional fluid cosmetics containers. Again in common with conventional containers, it may be molded of plastic or fabricated of other suitable material such as metal. At one end it has a neck 10*a* providing an opening through which the applicator stem 16 can be inserted into the reservoir 11; a conventional flexible wiper 10*b* may be mounted in the neck to wipe excess cosmetic fluid from the applicator stem as the stem is withdrawn from the container.

The reservoir 11 of this container is simply the single, simple internal fluid-holding chamber defined and enclosed by the hollow container body. For simplicity of illustration, the air-liquid interface 14*a* of the body of fluid cosmetic material 14 is represented, in FIG. 1, in the position it would assume if the container were standing vertically on its flat distal end 10*c*, i.e. in upright position with the neck 10*a* at the top.

The applicator stem is a substantially rigid, elongated cylindrical shaft, e.g. molded of plastic, having a hollow distal end 16*a* and a proximal end 16*b* formed with a rigid flange 16*c* which seats on and closes the outer opening of the container neck 10*a*. The stem end 16*b* protrudes outwardly beyond the neck, when the flange is thus seated, so that the applicator is manually graspable by a user. A conventional cap (not shown) may be secured to this outwardly protruding stem end 16*b*, and may have an internal thread mating with an external thread (also not shown) on the outer surface of the neck 10*a* to secure the applicator to the container in closed position.

The system constituted of container 10 and applicator 12 as thus far described corresponds to a conventional purse-size cosmetics applicator system. Indeed, the container 10, the wiper 10*b*, the cap (not shown), and the configuration of the proximal portion of the stem 16 including flange 16*c*, as well as the overall length and outer diameter of the stem, may be wholly conventional, to facilitate incorporation of the invention in present-day commercial packaging with minimal changes in tooling and assembly.

As a particular feature of the invention, in its illustrated embodiment, the stem 16 has a hollow interior region or bore, opening through the distal end 16*a* and extending therefrom for some distance (toward the proximal end of the stem) along the stem axis. The proximal portion of this hollow interior region constitutes a second fluid reservoir 22, within the stem 16, and is in pressure-equalizing communication with ambient atmosphere through a small lateral vent 24 formed in the stem adjacent the proximal end of reservoir 22. The reservoir 22 is preferably dimensioned to hold at least enough fluid eyeliner product for a complete single application of product to both of a user's eyelids, so that a user can apply a complete draw line in a single stroke of the applicator 12, without having to reinsert the applicator into the primary reservoir 11. A reservoir of such capacity can readily be accommodated within the stem 16.

Between the reservoir 22 and the distal end of the stem, the hollow interior region or bore of the stem is enlarged to constitute a passage 26, in which the applicator tip 17 is inserted. The reservoir 22 at its distal extremity opens directly into the proximal extremity of passage 26, a shoulder 28 being formed between the reservoir and passage.

Figure 2:
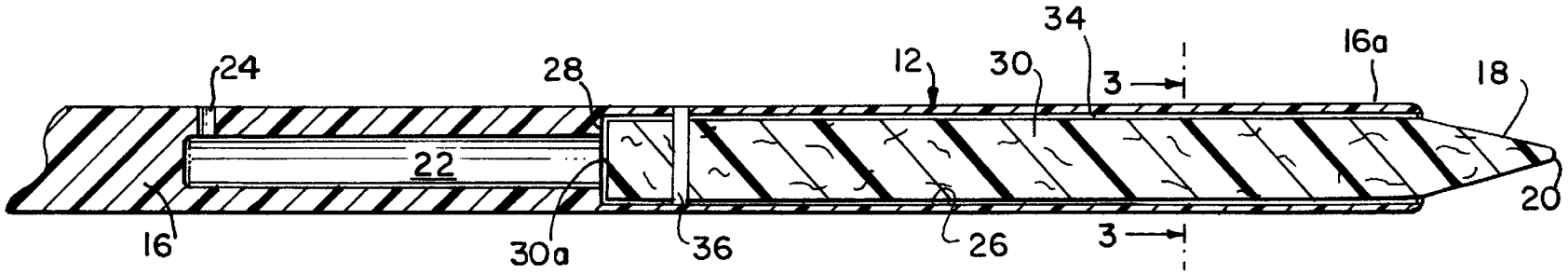
FIG. 2 is a further enlarged fragmentary longitudinal sectional view of the applicator of the system of FIG. 1.
Figure 3:
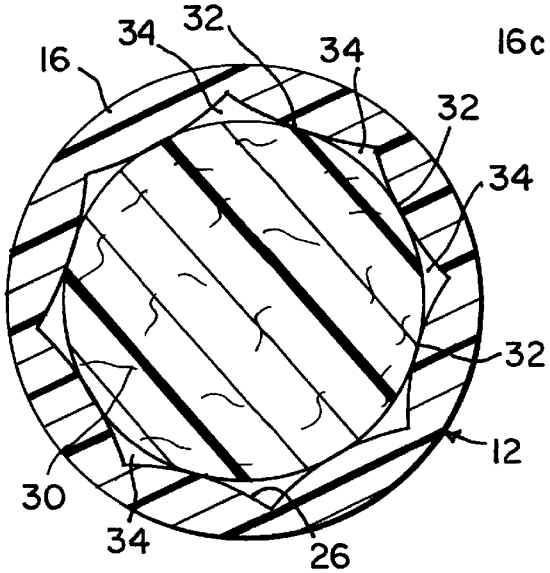
FIG. 3 is a still further enlarged cross-sectional view of the same applicator, taken along line 3—3 of FIG. 2.

The tip 17 is a unitary, integral element fabricated of a synthetic felt (as hereinafter further described), and is semi-rigid so as to be self-sustaining in shape. It may be characterized as solid in the sense that it contains no formed or macroscopic internal voids or passages. The tip includes an elongated shank or body portion 30, illustrated in FIGS. 2 and 3 as cylindrical, extending for a substantial distance within the passage 26 from the distal end 16*a* of the stem toward the reservoir 22; as shown, the body portion 30 may substantially fill the entire passage 26 both laterally and longitudinally between the shoulder 28 at the distal extremity of reservoir 22 and the stem distal end. Beyond the distal end of the stem, the tip protrudes, and is thus exposed; this exposed distal part of the tip constitutes the nib portion 18, which is advantageously formed to a conical shape tapering to a point of small radius at the application end 20.

Further in accordance with the invention, in the described embodiment, the stem is formed with a plurality of internal longitudinal splines 32 (eight such splines being shown in FIG. 3) extending along the inner wall of the passage 26 from end to end of the passage, i.e., from the shoulder 28 to the opening of the passage through the stem distal end 16*a*. The splines 32, spaced evenly around the circumference of the passage, engage the cylindrical peripheral surface of the tip body portion 30, thereby providing a corresponding plurality of longitudinal channels 34 defined between the peripheral surface of tip body portion 30 and the inner wall of passage 26. These channels, each extending uninterruptedly from shoulder 28 for the full length of the passage and opening outwardly at stem distal end 16*a* around the periphery of the tip 17, cooperatively constitute a path for flow of fluid cosmetic material (eyeliner product) between the distal end of the stem and the second reservoir 22, through the passage 26 and externally of the tip body portion 30.

The body portion 30 of the tip is anchored in the passage 26 by means of a stainless steel pin 36 extending transversely through body portion 30 and adjacent passage wall portions of the stem 16. To ensure a continuous, unimpeded path for fluid flow between reservoir 22 and channels 34, externally of the body portion 30, the pin 36 holds the body portion 30 in a position at which there is clearance between the proximal end 30*a* of the body portion and the shoulder 28.

The operation of the described system may now be readily understood. Initially, the primary reservoir 11 of container 10 is filled with the fluid cosmetic material (eyeliner product) 14, and the applicator 12 (with the second reservoir 22 initially empty) is inserted in the container as shown in FIG. 1, being typically secured in place by threaded engagement of the container neck and applicator cap (not shown) as described above. The nib portion 18 of the tip 17, the distal end 16*a* of the stem 16, and at least a substantial length of the stem 16 extending proximally from end 16*a* are thereby in contact with, and immersed in, the body of fluid material 14. As a result of capillary action and hydrostatic pressure (liquid finding its own level), fluid of the body 14 enters the channels 34 at their distal end openings and rises through the channels within the stem 16 to the second reservoir 22, filling the latter reservoir. This filling of reservoir 22 is effectively automatic, as it requires no manipulation other than the insertion of the applicator in the container.

For application of the eyeliner, a user unscrews and withdraws the applicator 12 (having its contained reservoir 22 filled with the eyeliner product) from the container. The nib portion 18 is at this time coated externally with the eyeliner product in which it was immersed in the container, and the channels 34 as well as the reservoir 22 are filled with the product. As the user draws the application end along an eyelid (for example), transferring eyeliner from the application end to the eyelid, eyeliner product is drawn by capillary action from the channels 34 to the nib portion, and from the reservoir 22 into and along the channels 34, in a continuous flow that replenishes the product on the nib portion until the application (creating a draw line) is complete, the capacity of reservoir 22 being sufficient for this purpose.

That is to say, the capillary action of the synthetic felt tip 17 allows the nib portion with its application end to be continually resaturated by drawing product from the reservoir 22 through channels 34 during user application. The device accomplishes metered and controlled flow of product by the configuration of the longitudinal splines which are equispaced around the periphery of the tip 17 and allow free flow from the stem reservoir 22 to the point of application; vent 24 cooperates in maintaining this continuing flow by equalizing pressure between the interior of reservoir 22 and ambient atmosphere as product is withdrawn from the reservoir during application. As the channels 34 feed product from reservoir 22 to coat the outer periphery of nib portion 18, the nib portion in turn through capillary action carries the product continuously to the application end 20; this action is continuous until the reservoir is depleted. Therefore, the nib 18 and applicator end 20 will not dry up for lack of product; moreover, owing to the capillary feeding action, which delivers product to the application end 20 only at a rate sufficient to replace the material transferred to the eyelid, nib 18 and end 20 will not accumulate excess product and are consequently virtually drip proof and smudge proof.

The applicator of the invention supplies enough product to line each eyelid with one continuous stroke, affording superior line precision. Both lids can be lined without having to reinsert the applicator back into the container, with ample product to spare in the reservoir 22.

Eyeliner products containing, for example, iron oxide pigments feed well because the feeding is accomplished through channels on the exterior of the felt tip, rather than through the center or interior of a wick where clogging or filtering-out of pigment particles can occur; i.e., the product does not wick through the felt itself, but flows around the outside of the felt tip 17 by capillary action on the felt surface. This feeding of product externally of tip 17 allows for the clog-free use of a variety of pigmentation formulas and products of higher viscosity.

The length of the tip (body portion 30) within the passage 26 assures that during the start of each application the product flow is sufficient and uninterrupted, by allowing enough product in and around the felt and longitudinal splines to compensate for any air pockets or voids in the reservoir which would hinder continual free flow.

When application is complete, the applicator is reinserted into the container 10, so that the stem and nib portion are reimmersed in the body of fluid product 14 in the reservoir 11. The reservoir 22 then is automatically refilled from the reservoir 11 through channels 34, again by capillary action and hydrostatic pressure, in the same manner as in the case of the initial filling of reservoir 22 described above, so as to be ready for another application.

The tip 17 is made from a felt material, and preferably polyester fiber. Polyester fiber is particularly well suited for manufacture of fiber strands required in the felting process. The material gives both a soft surface texture and adequate structural strength to accommodate precision grinding or profiling of the shaped nib portion 18 and to provide a rigid support for application. The knitted felt fibers are bonded together by a conventional bonding agent, e.g. a bonding resin; the art of felting is well known in the industry. The felt tip can have any shape and any porosity. Thus, the tip can be customized to suit any application need or product variable. A suitable felt material is commercially available from Spartan Felt Company, Spartanburg, S.C.

Stated generally, the tip is sufficiently rigid so that the applicator end will be substantially self-sustaining in shape under manual application pressure, i.e. will not distort over a wide range of such pressure; hence individual differences in the pressure applied by different users do not tend to cause the application end to splay out or otherwise undesirably vary the line width. Precision draw lines are therefore readily and reliably attainable. At the same time, the felt is gentle enough not to be irritating or abrasive to the eyelid.

The present invention is a cost effective alternative to existing applicator systems because it can be incorporated into conventional eyeliner packaging. Manufacturers can use stock components to manufacture and package the eyeliner system of the present invention.

While particular configurations have been described, viz. cylindrical shapes of the tip body portion and stem, conical profiling of the nib portion, etc., any suitable cross-sections may be employed for these elements.

It is to be understood that the invention is not limited to the features and embodiments hereinabove specifically set forth, but may be carried out in other ways without departure from its spirit.

What is claimed is:

1. A system for applying a fluid cosmetic material, comprising:

(a) means for defining a first reservoir for holding a body of the cosmetic material, and having an opening for access to the first reservoir; and (b) an applicator for transporting quantities of the cosmetic material from the first reservoir to a user's face, the applicator having a stem with a distal end insertable through the opening into contact with the cosmetic material in the first reservoir, and a tip having a nib portion exposed at the distal end of the stem for applying the cosmetic material to the face;

(c) said applicator having a second reservoir spaced from said distal end for receiving a quantity of the cosmetic material, (d) said stem having a passage communicating between the second reservoir and said distal end, (e) said tip having a body portion inserted in said passage and cooperating therewith to define a path for flow of the cosmetic material between said distal end and said second reservoir, through said passage and externally of said body portion along the length of said body portion, such that cosmetic material flows from the first reservoir to the second reservoir when said distal end is in contact with the cosmetic material in the first reservoir, and flows from the second reservoir to the nib portion during subsequent application of cosmetic material from the nib portion to a user's face or like application locality, said tip having sufficient rigidity so that said nib portion is self-sustaining in shape under manual cosmetic-applying pressures, and (f) said path opening through said distal end such that cosmetic material from said second reservoir flows therethrough over the nib portion.

2. A system as defined in claim 1, wherein said path comprises a plurality of channels spaced around and extending along the length of said body portion in said passage.

3. A system as defined in claim 2, wherein said stem is formed with a plurality of internal longitudinal splines, spaced around said passage and extending along and engaging said body portion of said tip, for defining therewith said channels.

4. A system as defined in claim 1, wherein said applicator defines a vent for equalizing pressure between said second reservoir and ambient atmosphere.

5. A system as defined in claim 1, wherein said tip is a formed synthetic felt body.

6. An eyeliner applicator system comprising:

(a) a container defining a first reservoir holding a body of eyeliner containing iron oxide pigment, and having an opening for access to the first reservoir; and (b) an applicator for transporting quantities of the eyeliner from the first reservoir to a user's face, the applicator having a stem with a hollow distal end insertable through the container opening into contact with the eyeliner in the first reservoir, and a synthetic felt tip inserted in and having a nib portion exposed at the distal end of the stem for applying the eyeliner to the face;

(c) said stem defining a second reservoir spaced from said distal end for receiving a quantity of the eyeliner, and a passage communicating between the second reservoir and said distal end, (d) said tip having a body portion inserted in said passage and cooperating therewith to define a plurality of longitudinal channels, spaced around and extending along the length of said body portion in said passage, for flow of the eyeliner between said distal end and said second reservoir, such that eyeliner flows from the first reservoir to the second reservoir when said distal end is in contact with the eyeliner in the first reservoir, and flows from the second reservoir along and externally of said body portion to the nib portion during subsequent application of eyeliner from the nib portion to a user's face or like application locality, said tip having sufficient rigidity so that said nib portion is self-sustaining in shape under manual eyeliner-applying pressures, and (e) said channels opening through said distal end such that eyeliner from said second reservoir flows therethrough over the nib portion.

7. A system as defined in claim 6, wherein said stem has a manually graspable proximal end that protrudes from said container opening when said distal end is fully inserted therein.

8. A system as defined in claim 6, wherein said stem is formed with a plurality of internal longitudinal splines, spaced around said passage and extending along and engaging said body portion of said tip, for defining therewith said channels.

9. A system as defined in claim 8, wherein said stem has a vent for equalizing pressure between said second reservoir and ambient atmosphere.

10. A system as defined in claim 6, wherein said tip is a formed synthetic felt body.

11. For use with a container holding a body of a fluid cosmetic material, a cosmetic material applicator comprising:

(a) a stem with a distal end insertable into the container for contact with a fluid cosmetic material contained therein; and (b) a tip having a nib portion exposed at the distal end of the stem for applying the cosmetic material to a user's face;

(c) said applicator having a reservoir spaced from said distal end for receiving a quantity of the cosmetic material, (d) said stem having a passage communicating between the reservoir and said distal end, (e) said tip having a body portion inserted in said passage and cooperating therewith to define a path for flow of the cosmetic material between said distal end and said reservoir, through said passage and externally of said body portion along the length of said body portion, such that cosmetic material flows from the container to the reservoir when said distal end is in contact with the cosmetic material in the container, and flows from the reservoir to the nib portion during subsequent application of cosmetic material from the nib portion to a user's face or like application locality, said tip having sufficient rigidity so that said nib portion is self-sustaining in shape under manual cosmetic-applying pressures, and (f) said path opening through said distal end such that cosmetic material from said second reservoir flows therethrough over the nib portion.

12. A applicator as defined in claim 11, wherein said path comprises a plurality of channels spaced around and extending along said body portion in said passage.

13. A applicator as defined in claim 12, wherein said stem is formed with a plurality of internal longitudinal splines, spaced around said passage and extending along and engaging said body portion of said tip, for defining therewith said channels.

14. A applicator as defined in claim 1, wherein said reservoir is formed in said stem and said stem has a vent for equalizing pressure between said reservoir and ambient atmosphere.

15. A applicator as defined in claim 11, wherein said tip is a formed synthetic felt body.

* * * * *